US006788269B2

(12) United States Patent
Chiba et al.

(10) Patent No.: US 6,788,269 B2
(45) Date of Patent: Sep. 7, 2004

(54) SIMPLIFIED FEED CIRCUIT FOR AN ARRAY ANTENNA DEVICE

(75) Inventors: Isamu Chiba, Tokyo (JP); Kazunari Kihira, Tokyo (JP); Rumiko Yonezawa, Tokyo (JP); Shuji Urasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/257,947

(22) PCT Filed: Feb. 26, 2001

(86) PCT No.: PCT/JP01/01420

§ 371 (c)(1),
(2), (4) Date: Mar. 3, 2003

(87) PCT Pub. No.: WO02/069449

PCT Pub. Date: Sep. 6, 2002

(65) Prior Publication Data

US 2003/0164804 A1 Sep. 4, 2003

(51) Int. Cl.[7] ..... H01Q 21/00
(52) U.S. Cl. ..... 343/853
(58) Field of Search ..... 343/853, 854; 342/372

(56) References Cited

U.S. PATENT DOCUMENTS 3,740,756 A * 6/1973 Sosin ..... 343/853
4,101,901 A * 7/1978 Kommrusch ..... 343/853
4,317,118 A * 2/1982 Corzine et al. ..... 342/350
4,376,940 A * 3/1983 Miedema ..... 343/840
4,414,550 A 11/1983 Tresselt
4,799,065 A * 1/1989 Thompson ..... 343/779

FOREIGN PATENT DOCUMENTS

| | | |
|---|---|---|
| JP | 52-19935 | 2/1977 |
| JP | 61-169002 | 7/1986 |
| JP | 63-19901 | 1/1988 |
| JP | 63-19902 | 1/1988 |
| JP | 64-67005 | 3/1989 |

* cited by examiner

*Primary Examiner*—Tho Phan
(74) *Attorney, Agent, or Firm*—Oblon, Spivak, McClelland, Maier & Neustadt, P.C.

(57) ABSTRACT

There are disposed four antenna elements which are arranged circumferentially at regular intervals, and four 90-degree hybrids each having four terminals, two 90-degree hybrids which are arranged in parallel are connected in two stages, only one of the output terminals of an upstream 90-degree hybrid and only one of the input terminal of a downstream 90-degree hybrid cross each other and are connected to each other, and the four output terminals of the two downstream 90-degree hybrids and the four antenna elements are connected to each other; the passing phase between the terminals that cross each other within the respective 90-degree hybrids is set to 0 degree, and the passing phase between the terminals that are in parallel within the respective 90-degree hybrids is set to 90 degrees. As a result, the structure of the feed circuit can be simplified, and plural kinds of beams can be formed.

3 Claims, 9 Drawing Sheets

SIMPLIFIED FEED CIRCUIT FOR AN ARRAY ANTENNA DEVICE

TECHNICAL FIELD

The present invention relates to an antenna device having a feed circuit that composes a plurality of beams in an array antenna which is arranged circumferentially.

BACKGROUND ART

A conventional antenna device will be described with reference to the accompanying drawings. FIG. 9 is a diagram showing the structure of a conventional antenna device which is disclosed, for example, in Japanese Patent Laid-Open No. 61-169002.

Referring to FIG. 9, reference symbol 2 denotes an entire feed circuit; E0, E1, E2, E3 and E4 are antenna elements; H2 is a 180-degree hybrid; Dm is a reflection free termination; Ac is an amplitude adjuster; Pc is a phase compensating circuit; H1 is a 90-degree hybrid; Pb is a four-division divider; and F1, F2, F3 and F4 are feed terminals.

Then, the operation of the conventional antenna device will be described with reference to the accompanying drawings.

When an electricity is fed to the feed terminal F1 by the hybrids H1, H2, the phase compensating circuit Pc and the amplitude adjuster Ac, the excitation amplitude phases of ja, exp(jp(ω)), −exp(jp(ω)), j(1−a/2)A(ω), and j(1−a/2)A(ω) are fed to the five antenna elements E0, E1, E2, E3 and E4, respectively.

Similarly, when an electricity is fed to the feed terminal F2, the excitation amplitude phases of ja, j(1−a/2)A(ω), j(1−a/2)A(ω), exp(jp(ω)), and −exp(jp(ω)) are fed to the five antenna elements E0, E1, E2, E3 and E4, respectively.

Similarly, when an electricity is fed to the feed terminal F3, the excitation amplitude phases of ja, −exp(jp(ω)), exp(jp(ω)), j(1−a/2)A(ω), and j(1−a/2)A(ω) are fed to the five antenna elements E0, E1, E2, E3 and E4, respectively.

Similarly, when an electricity is fed to the feed terminal F4, the excitation amplitude phases of ja, j(1−a/2)A(ω), j(1−a/2)A(ω), −exp(jp(ω)), and exp(jp(ω)) are fed to the five antenna elements E0, E1, E2, E3 and E4, respectively.

With the above operation, the feed points of the feed terminals F1, F2, F3 and F4 are changed over, to thereby change over the beams of four kinds so as to conduct the transmit/receive of the signal.

In the above-mentioned conventional antenna device, in order that the four antenna elements E1 to E4 which are arranged circumferentially and the antenna element E0 of one element which exists in the center thereof are excited to form the four kinds of beams, the twelve 90-degree hybrid circuits H1, the four 180-degree hybrid circuits H2, the four amplitude adjusters Ac, the four phase compensating circuits Pc and the four-division divider circuits Pb must be connected in multiple stages.

For example, even in the case where the array structure is made up of only four elements which are arranged circumferentially except for the one element which is disposed in the center of a circle, the four-division divider circuit Pb is merely removed. Therefore, there arise such problems that hardware becomes complicated, a connection loss becomes large and a signal to noise ratio (hereinafter referred to as "SN ratio") is deteriorated.

The present invention has been made in order to solve the above-mentioned problems, and therefore an object of the present invention is to obtain an array antenna device which is capable of forming plural kinds of beams by a simple feed circuit structure in an array antenna which has four antenna elements which are arranged circumferentially and have a diameter which is uneven times of the half wavelength as a unit.

DISCLOSURE OF THE INVENTION

An antenna device according to claim 1 of the invention includes: first, second, third and fourth antenna elements which are arranged circumferentially at regular intervals; a first 90-degree hybrid having first, second, third and fourth terminals; a second 90-degree hybrid having fifth, sixth, seventh and eighth terminals; a third 90-degree hybrid having ninth, tenth, eleventh and twelfth terminals, and a fourth 90-degree hybrid having thirteenth, fourteenth, fifteenth and sixteenth terminals, in which: the third terminal of the first 90-degree hybrid and the ninth terminal of the third 90-degree hybrid are connected to each other; the fourth terminal of the first 90-degree hybrid and the thirteenth terminal of the fourth 90-degree hybrid are connected to each other; the seventh terminal of the second 90-degree hybrid and the tenth terminal of the third 90-degree hybrid are connected to each other; the eighth terminal of the second 90-degree hybrid and the fourteenth terminal of the fourth 90-degree hybrid are connected to each other; the eleventh terminal of the third 90-degree hybrid and the first antenna element are connected to each other; the twelfth terminal of the third 90-degree hybrid and the second antenna element are connected to each other; the fifteenth terminal of the fourth 90-degree hybrid and the third antenna element are connected to each other; the sixteenth terminal of the fourth 90-degree hybrid and the fourth antenna element are connected to each other; the passing phases of from the first terminal of the first 90-degree hybrid to the fourth terminal, from the second terminal to the third terminal, from the fifth terminal of the second 90-degree hybrid to the eighth terminal, from the sixth terminal to the seventh terminal, from the ninth terminal of the third 90-degree hybrid to the twelfth terminal, from the tenth terminal to the eleventh terminal, from the thirteenth terminal of the fourth 90-degree hybrid to the sixteenth terminal, and from the fourteenth terminal to the fifteenth terminal are set to 0 degree; and the passing phases of from the first terminal of the first 90-degree hybrid to the third terminal, from the second terminal to the fourth terminal, from the fifth terminal of the second 90-degree hybrid to the seventh terminal, from the sixth terminal to the eighth terminal, from the ninth terminal of the third 90-degree hybrid to the eleventh terminal, from the tenth terminal to the twelfth terminal, from the thirteenth terminal of the fourth 90-degree hybrid to the fifteenth terminal, and from the fourteenth terminal to the sixteenth terminal are set to 180 degrees.

An antenna device according to claim 2 of the invention includes: first, second, third and fourth antenna elements which are arranged circumferentially at regular intervals; a first 180-degree hybrid having first, second, third and fourth terminals; a second 180-degree hybrid having fifth, sixth, seventh and eighth terminals; and a third 180-degree hybrid having ninth, tenth, eleventh and twelfth terminals, in which: the third terminal of the first 180-degree hybrid and the fifth terminal of the second 180-degree hybrid are connected to each other; the fourth terminal of the first 180-degree hybrid and the ninth terminal of the third 180-degree hybrid are connected to each other; the seventh terminal of the second 180-degree hybrid and the first antenna element are connected to each other; the eighth terminal of the second 180-degree hybrid and the second antenna element are connected to each other; the eleventh terminal of the third 180-degree hybrid and the third antenna element are connected to each other; the twelfth terminal of the third 180-degree hybrid and the fourth antenna element are connected to each other the passing phases of from the first terminal of the first 180-degree hybrid to the fourth terminal, from the second terminal to the third terminal, from the fifth terminal of the second 180-degree hybrid to the eighth terminal, from the sixth terminal to the seventh terminal, from the ninth terminal of the third 180-degree hybrid to the twelfth terminal, and from the tenth terminal to the eleventh terminal are set to 0 degree; and the passing phases of from the first terminal of the first 180-degree hybrid to the third terminal, from the second terminal to the fourth terminal, from the fifth terminal of the second 180-degree hybrid to the seventh terminal, from the sixth terminal to the eighth terminal, from the ninth terminal of the third 180-degree hybrid to the eleventh terminal, and from the tenth terminal to the twelfth terminal are set to 180 degrees.

An antenna device according to claim 3 of the invention further includes in the above-mentioned antenna device according to claim 1, a signal processing unit that composes beams by multiplying a complex excitation amplitude whose amplitude is in proportion to the amplitudes of the signals which are received at the first and second terminals of the first 90-degree hybrid and the fifth and sixth terminals of the second 90-degree hybrid, and whose phase is the inversion of the signs of the phases of the signals of the first and second terminals of the first 90-degree hybrid and the fifth and sixth terminals of the second 90-degree hybrid.

An antenna device according to claim 4 of the invention further includes in the above-mentioned antenna device according to claim 1, a signal processing unit that directs a main beam in an arrival direction of a desired signal and forms a zero point of the directivity of the beam in an arrival direction of an interference signal on the basis of the signals which are inputted from the first and second terminals of the first 90-degree hybrid and the fifth and sixth terminals of the second 90-degree hybrid.

BEST MODES FOR CARRYING OUT THE INVENTION

Hereinafter, the respective embodiments of the present invention will be described with reference to the accompanying drawings.

First Embodiment

Figure 1:
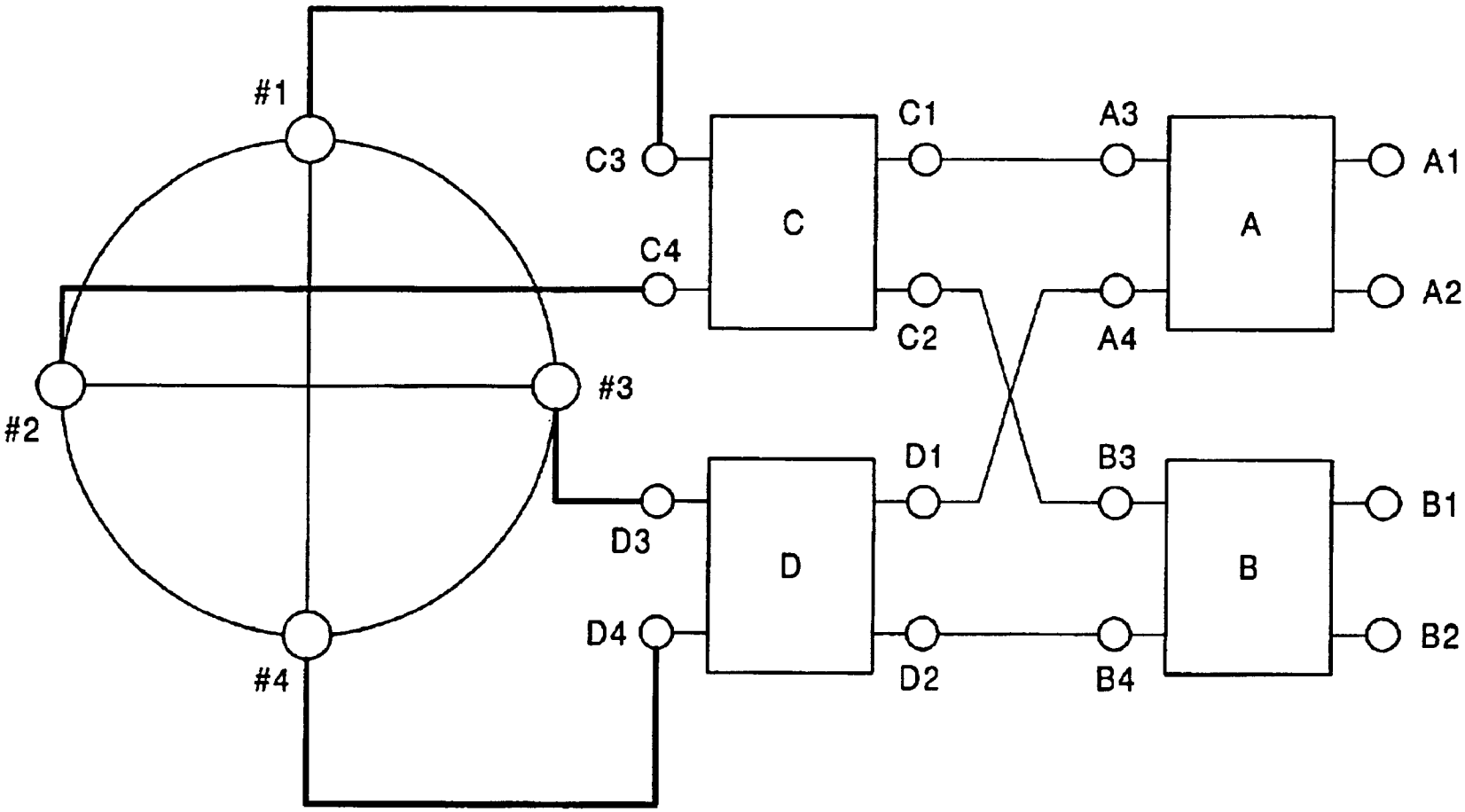
FIG. 1 is a diagram showing the structure of an antenna device in accordance with a first embodiment of the present invention.

An antenna device in accordance with a first embodiment of the present invention will be described with reference to the accompanying drawings. For simplification, the embodiment will be described by a unit of four elements. FIG. 1 is a diagram showing the structure of an antenna device in accordance with the first embodiment of the present invention. In the respective drawings, the same references designate identical or like parts.

Referring to FIG. 1, #1, #2, #3 and #4 denote antenna elements, respectively, and it is assumed that #1 and #4, and #2 and #3 are positioned on both ends of the diameter of a circle. In this case, the diameter of the circle is set so as to have the length that is uneven times of a half wavelength.

Also, in the figure, A, B, C and D are 90-degree hybrids. It is assumed that the terminals of the respective 90-degree hybrid are A1, A2, A3 and A4, B1, B2, B3 and B4, C1, C2, C3 and C4, and D1, D2, D3 and D4, respectively.

When it is assumed that A1 and A2, B1 and B2, C1 and C2, and D1 and D2 are input terminals, A3 and A4, B3 and 34, C3 and C4, and D3 and D4 are output terminals, it is assumed that the passing phases of from the input terminal A1 to the output terminal A4, from the input terminal A2 to the output terminal A3, from the input terminal B1 to the output terminal B4, from the input terminal B2 to the output terminal B3, from the input terminal C1 to the output terminal C4, from the input terminal C2 to the output terminal C3, from the input terminal D1 to the output terminal D4, and from the input terminal D2 to the output terminal D3 are 0° (degree), and the passing phases of from the input terminal A1 to the output terminal A3, from the input terminal A2 to the output terminal A4, from the input terminal B1 to the output terminal B3, from the input terminal B2 to the output terminal B4, from the input terminal C1 to the output terminal C3, from the input terminal C2 to the output terminal C4, from the input terminal D1 to the output terminal D3, and from the input terminal D2 to the output terminal D4 are 90° (degrees)

In this situation, the output terminal A3 and the input terminal C1, the output terminal A4 and the input terminal D1, the output terminal B3 and the input terminal C2, and the output terminal B4 and the input terminal D2 are connected to each other, respectively, and the output terminals C3, C4, D3 and D4 are connected to the antenna elements #1, #2, #3 and #4, respectively to feed the electricity.

Figure 2:
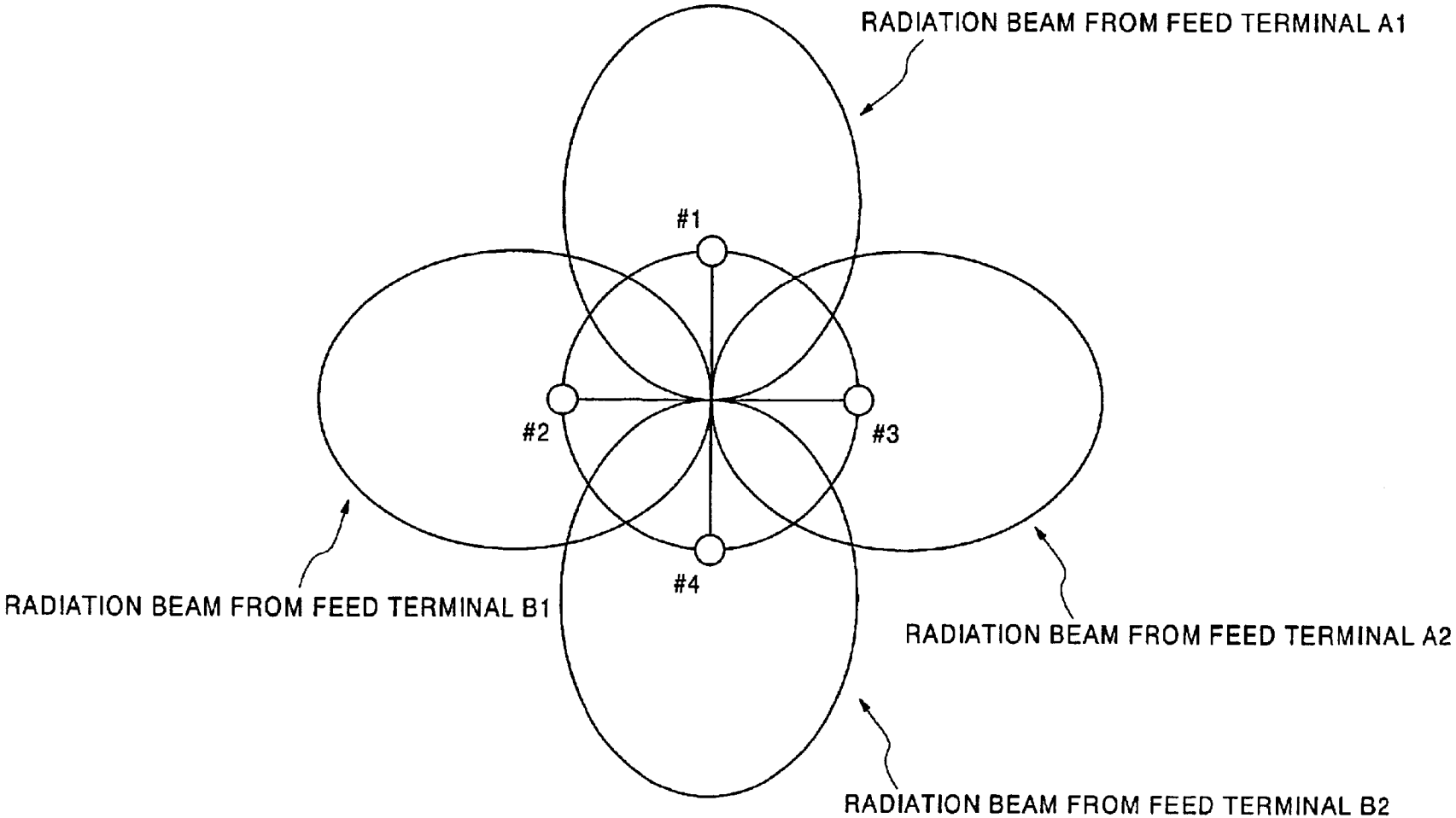
FIG. 2 is a diagram showing the radiation pattern of the antenna device in accordance with the first embodiment of the present invention.

Then, the operation of the antenna device in accordance with the first embodiment will be described with reference to the accompanying drawings. FIG. 2 is a diagram showing the radiation pattern of the antenna device in accordance with the first embodiment.

When the feed terminal (input terminal) A1 is excited, the phase of 180° is excited to the antenna element #1, the phase of 90° is excited to the antenna element #2, the phase of 90° is excited to the antenna element #3, and the phase of 0° is excited to the antenna element #4. In this situation, as shown in FIG. 2, a radiation pattern having a main beam is formed in the direction of the antenna element #1.

When the feed terminal (input terminal) A2 is excited, the phase of 90° is excited to the antenna element #1, the phase of 0° is excited to the antenna element #2, the phase of 180° is excited to the antenna element #3, and the phase of 90° is excited to the antenna element #4. In this situation, as shown in FIG. 2, a radiation pattern having a main beam is formed in the direction of the antenna element #3.

When the feed terminal (input terminal) B1 is excited, the phase of 90° is excited to the antenna element #1, the phase of 180° is excited to the antenna element #2, the phase of 0° is excited to the antenna element #3, and the phase of 90° is excited to the antenna element #4. In this situation, as shown in FIG. 2, a radiation pattern having a main beam is formed in the direction of the antenna element #2.

When the feed terminal (input terminal) B2 is excited, the phase of 0° is excited to the antenna element #1, the phase of 90° is excited to the antenna element #2, the phase of 90° is excited to the antenna element #3, and the phase of 180° is excited to the antenna element #4. In this situation, as shown in FIG. 2, a radiation pattern having a main beam is formed in the direction of the antenna element #4.

As described above, in the antenna device in accordance with the first embodiment, in the feed circuit which is made up of only four 90-degree hybrids, it is possible to change over the four main beams, and the complication of the hardware and the loss of the feed circuit are remarkably improved. The above description is given of a case of the four elements, but in the case where 4N array antennas in which N pairs having those four elements as a unit are arranged circumferentially are excited, 4N beams are formed on the basis of the same principle if the arrangement in accordance with the first embodiment is connected in multiple stages.

That is, the antenna device in accordance with the first embodiment includes four antenna elements #1 to #4 which are arranged circumferentially at regular intervals, and four 90-degree hybrids A, B, C and D having four terminals, in which two 90-degree hybrids which are arranged in parallel are connected in two stages, and the output terminals A4 and B3 of the upstream 90-degree hybrids A and B and the input terminals D1 and C2 of the downstream 90-degree hybrids D and C cross each other and are connected to each other; the four output terminals C3, C4, D3 and D4 of the two downstream 90-degree hybrids C and D and the four antenna elements are connected to each other, and the passing phase between the crossing terminals within the respective 90-degree hybrids is set to 0 degree, and the passing phase between the parallel terminals within the respective 90-degree hybrids is set to 90 degrees. As a result, the structure of the feed circuit can be simplified, and plural kinds of beams can be formed.

Second Embodiment

Figure 3:
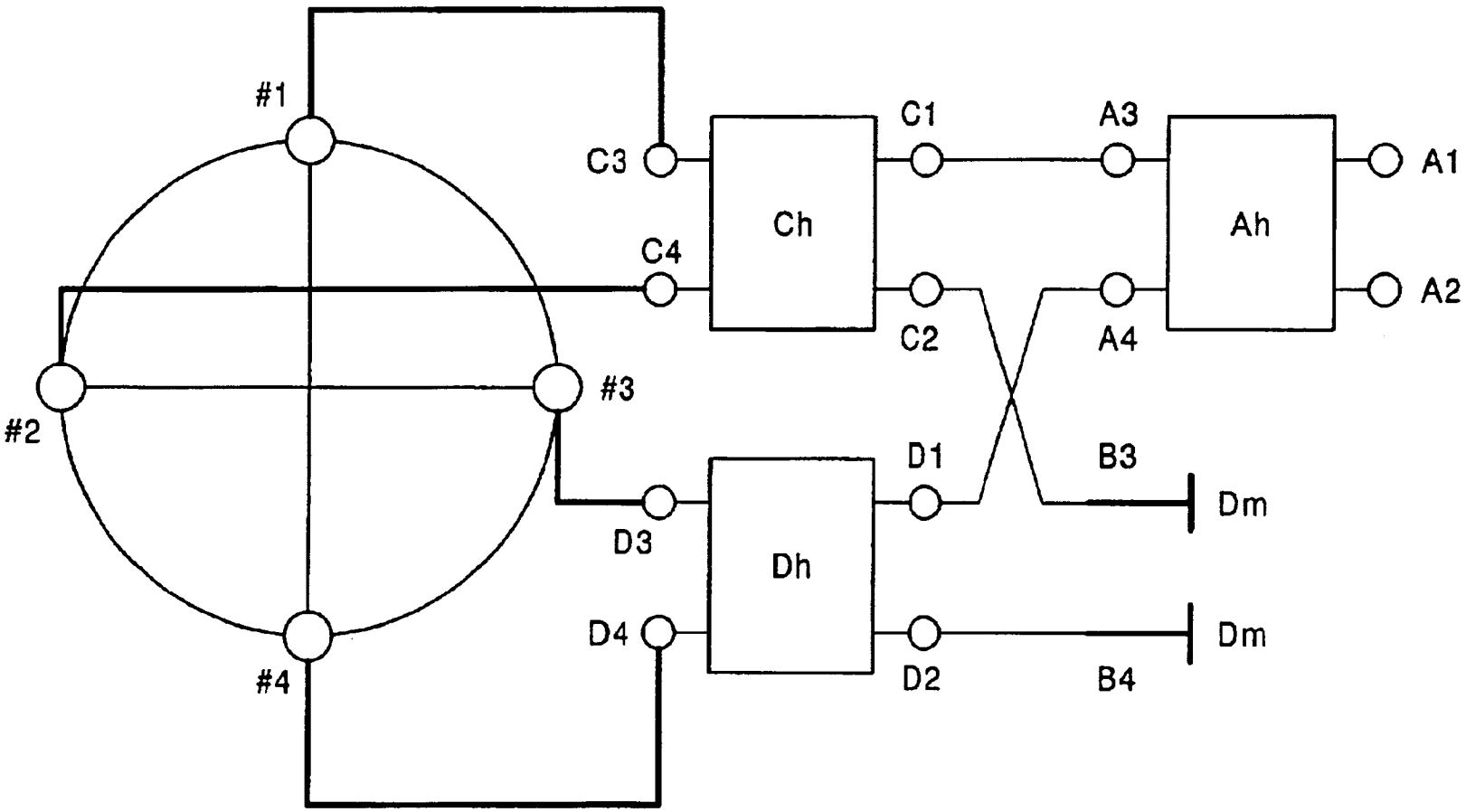
FIG. 3 is a diagram showing the structure of an antenna device in accordance with a second embodiment of the present invention.

An antenna device in accordance with a second embodiment of the present invention will be described with reference to the accompanying drawings. For simplification, the second embodiment will be described by a unit of four elements. FIG. 3 is a diagram showing the structure of an antenna device in accordance with a second embodiment of the present invention.

Referring to FIG. 3, #1, #2, #3 and #4 denote antenna elements, respectively, and it is assumed that #1 and #4, and #2 and #3 are positioned on both ends of the diameter of a circle. In this case, the diameter of the circle is set so as to have the length that is uneven times of one wavelength.

Also, in the figure, Dm is a reflection free termination. Also, Ah, Ch and Dh are 180-degree hybrids. It is assumed that the terminals of the respective 180-degree hybrid are A1, A2, A3 and A4, C1, C2, C3 and C4, and D1, D2, D3 and D4, respectively.

When it is assumed that A1 and A2, C1 and C2, and D1 and D2 are input terminals, A3 and A4, C3 and C4, and D3 and D4 are output terminals, it is assumed that the passing phases of from the input terminal A1 to the output terminal A4, from the input terminal A2 to the output terminal A3, from the input terminal C1 to the output terminal C4, from the input terminal C2 to the output terminal C3, from the input terminal D1 to the output terminal D4, and from the input terminal D2 to the output terminal D3 are 0° (degree), and the passing phases of from the input terminal A1 to the output terminal A3, from the input terminal A2 to the output terminal A4, from the input terminal C1 to the output terminal C3, from the input terminal C2 to the output terminal C4, from the input terminal D1 to the output terminal D3, and from the input terminal D2 to the output terminal D4 are 80° (degrees). In this case, the output terminal A3 and the input terminal C1, the output terminal A4 and the input terminal D1 are connected to each other, respectively, and a reflection free termination Dm is connected to the input terminals C2 and D2.

Figure 4:
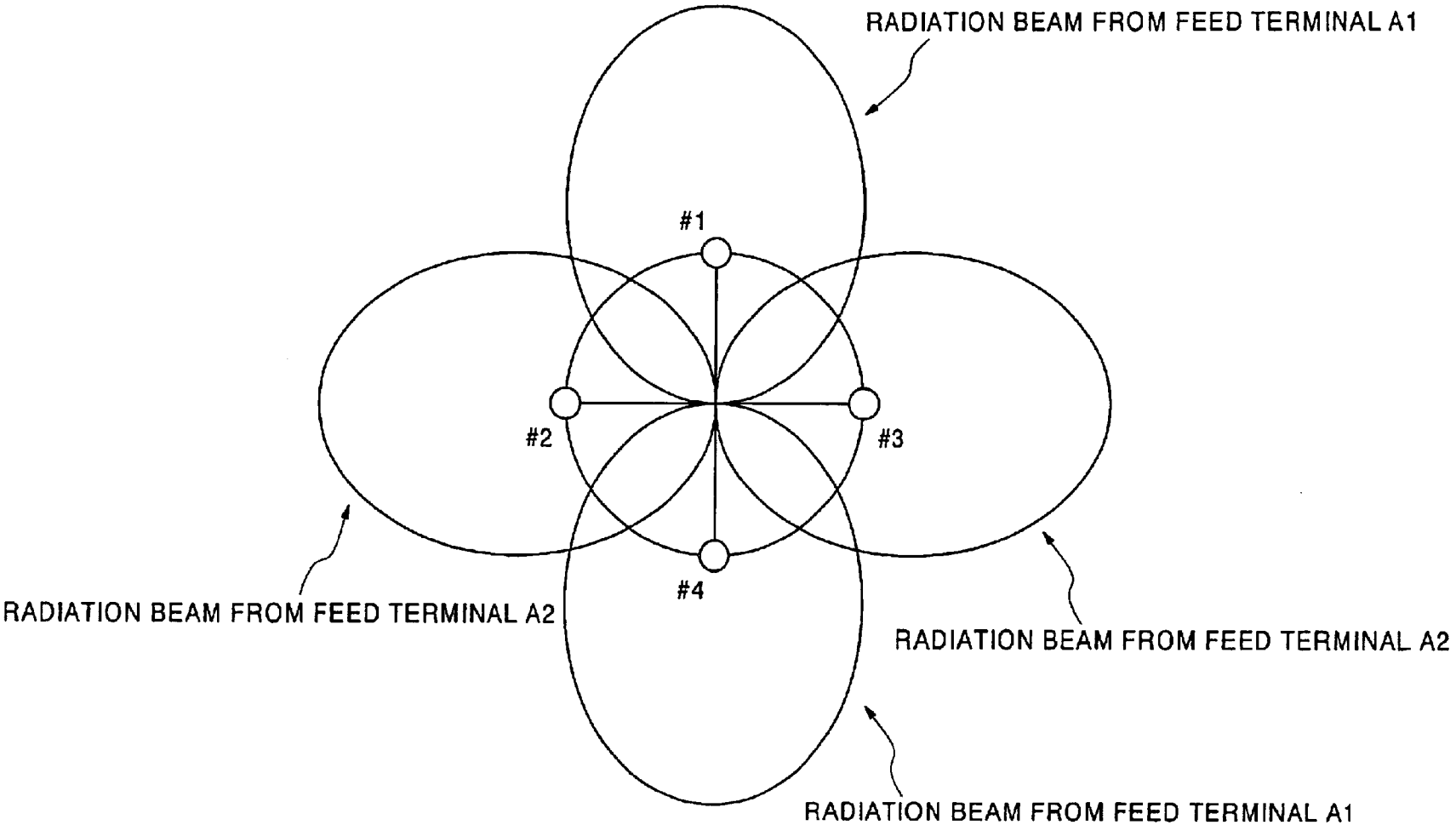
FIG. 4 is a diagram showing the radiation pattern of the antenna device in accordance with the second embodiment of the present invention.

Then, the operation of the antenna device in accordance with the second embodiment will be described with reference to the accompanying drawings. FIG. 4 is a diagram showing the radiation pattern of the antenna device in accordance with second embodiment.

When the feed terminal (input terminal) A1 is excited, the phase of 360° is excited to the antenna element #1, the phase of 180° is excited to the antenna element #2, the phase of 180° is excited to the antenna element #3, and the phase of 0° is excited to the antenna element #4. In this situation, as shown in FIG. 4, a radiation pattern having a main beam is formed in the direction of the antenna elements #1 and #4.

When the feed terminal (input terminal) A2 is excited, the phase of 180° is excited to the antenna element #1, the phase of 0° is excited to the antenna element #2, the phase of 360° is excited to the antenna element #3, and the phase of 180° is excited to the antenna element #4. In this situation, as shown in FIG. 4, a radiation pattern having a main beam is formed in the direction of the antenna elements #2 and #3.

The above description is given of a case of the four elements, but in the case where 4N array antennas in which N pairs having those four elements as a unit are arranged circumferentially are excited, 2N beams are formed on the basis of the same principle if the arrangement in accordance with the second embodiment is connected in multiple stages.

As described above, in the antenna device in accordance with the second embodiment, in the feed circuit which is made up of only three 180-degree hybrids, it is possible to change over the two main beams, and the complication of the hardware and the loss of the feed circuit are remarkably improved.

Third Embodiment

Figure 5:
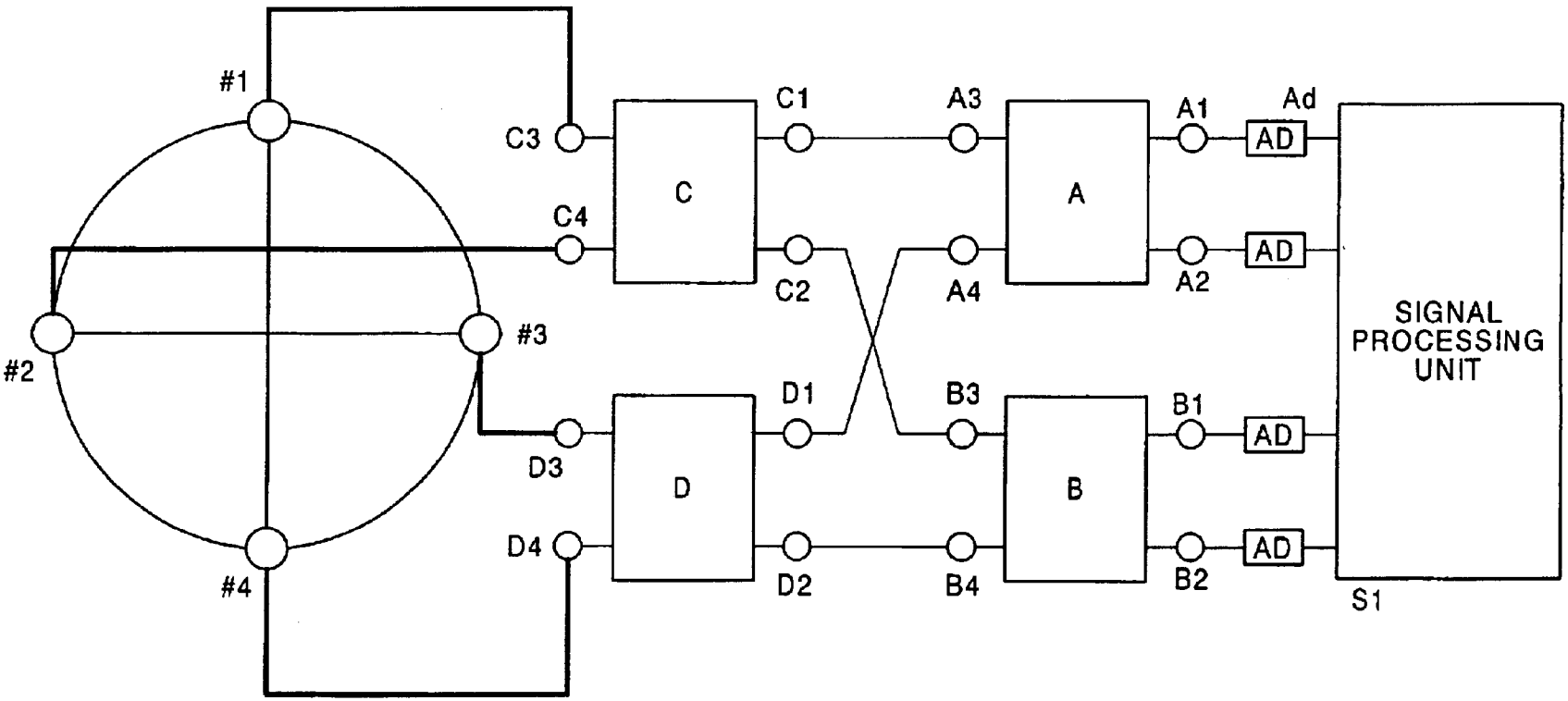
FIG. 5 is a diagram showing the structure of an antenna device in accordance with a third embodiment of the present invention.

An antenna device in accordance with a third embodiment of the present invention will be described with reference to the accompanying drawings. For simplification, the third embodiment will be described by a unit of four elements. FIG. 5 is a diagram showing the structure of an antenna device in accordance with the third embodiment of the present invention. FIG. 5 shows the structure of a receive system, and the D/A converter (digital/analog converter) of a transmit system and so on are omitted from the figure.

Referring to FIG. 5, reference symbol Ad denotes an A/D converter (analog/digital converter), and reference symbol S1 is a signal processing unit. In this example, the A/D converter is connected to each of the input terminals A1, A2, B1 and B2 of the 90-degree hybrids A and B, in which the receive signal (analog signal) of the beam is converted into a base band signal (digital signal).

Figure 6:
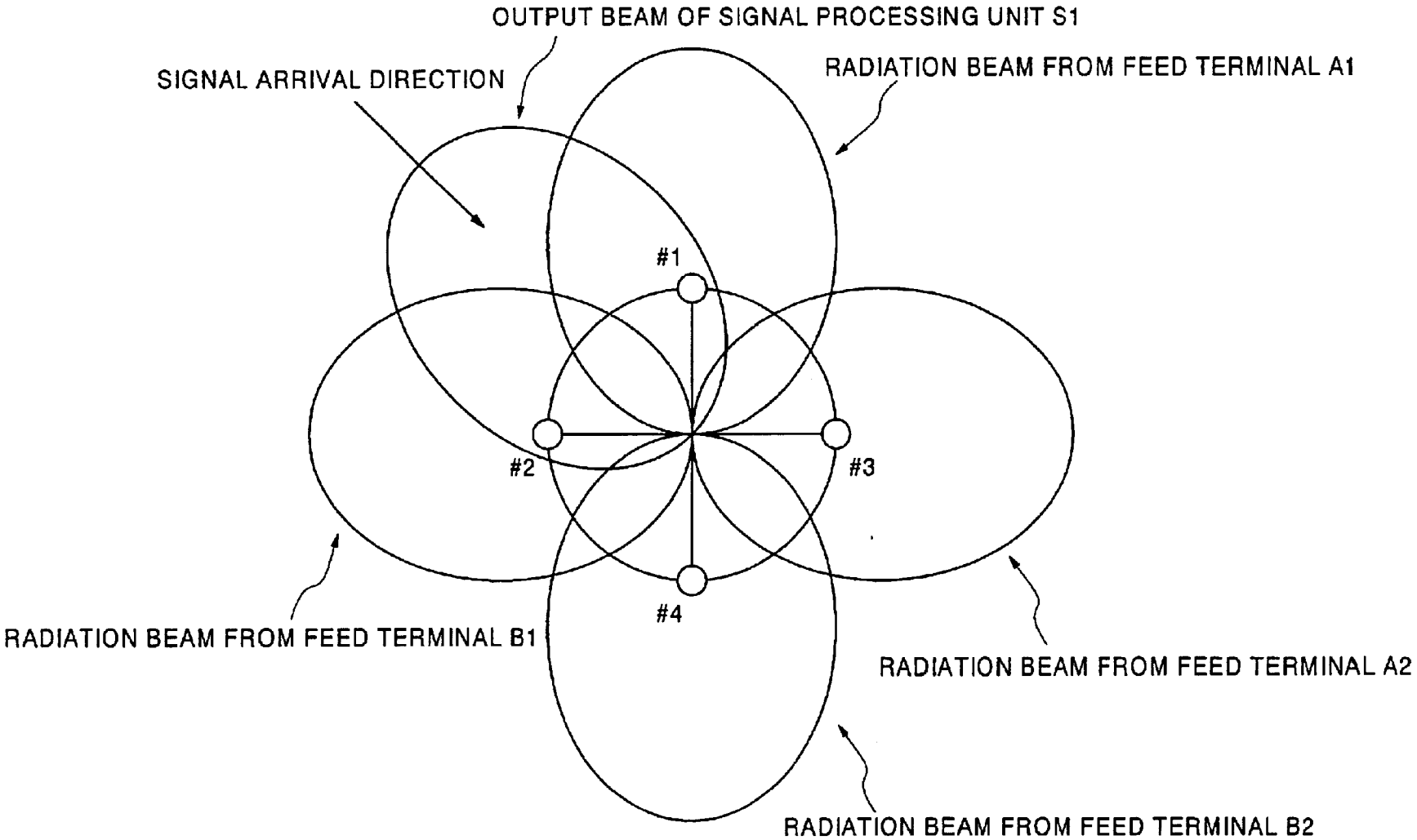
FIG. 6 is a diagram showing the radiation pattern of the antenna device in accordance with the third embodiment of the present invention.

As the operation of the signal processing device S1, a complex excited amplitude that is in proportion to the amplitude of a signal which is received at the respective terminals, and whose phase is the inversion of a sign of the phase of the signal of the respective terminals is multiplexed and composed. As a result, for example, as shown in FIG. 6, even in the case where a signal arrives between the respective beams shown in the above-described first embodiment, the directivity therebetween is enhanced, and the maximum ratio gain composition can be realized.

In other words, the antenna device in accordance with the third embodiment is that in the antenna device in accordance with the first embodiment, an A/D converter is disposed at each of the input terminals A1, A2, B1 and B2 in the case of receiving, respectively, and a D/A converter is disposed at each of the input terminals A1, A2, B1 and B2 in the case of transmission, respectively; the beam is multiplied by the complex excited amplitude whose amplitude is in proportion to the amplitude of the signal which is received at the respective terminals, and whose phase is the inversion of the sign of the phase of the signal at the respective terminals and composed.

Fourth Embodiment

Figure 7:
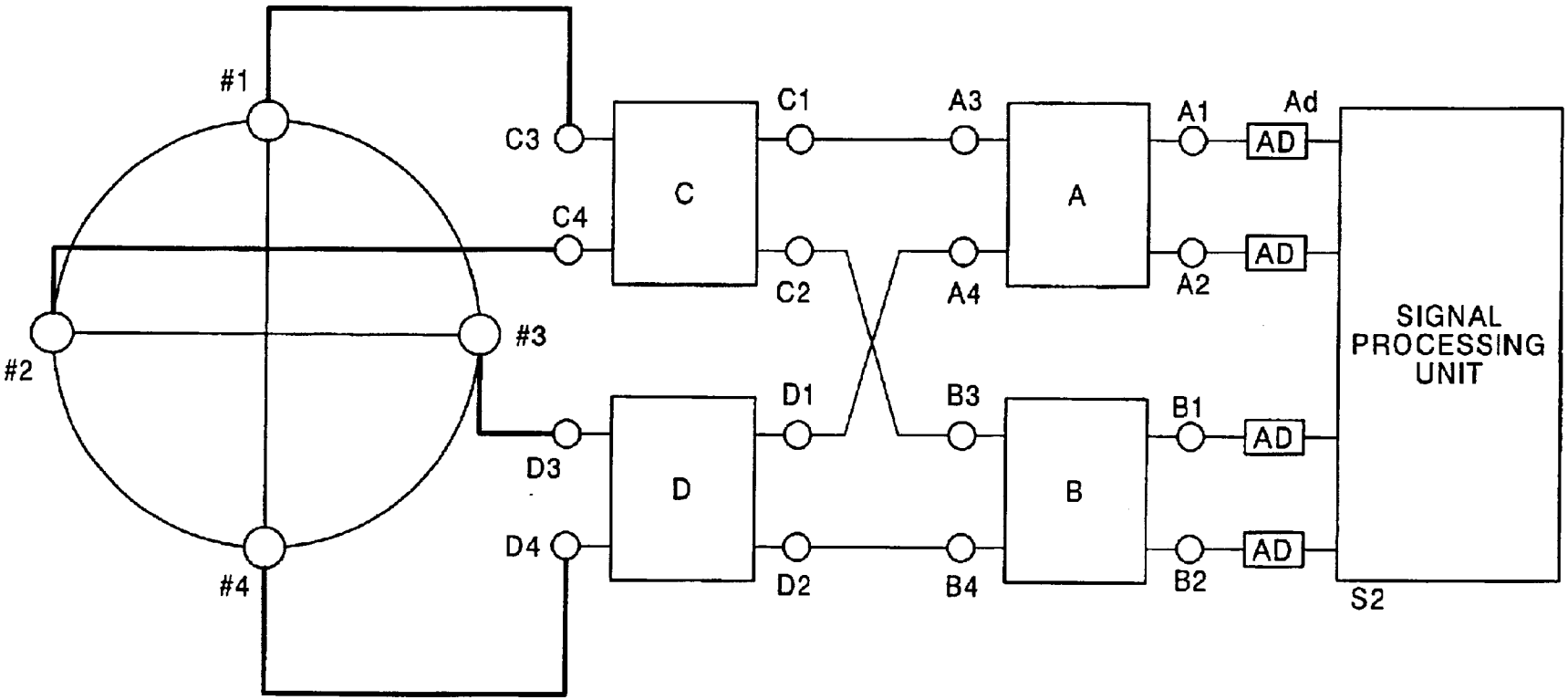
FIG. 7 is a diagram showing the structure of an antenna device in accordance with a fourth embodiment of the present invention.

An antenna device in accordance with a fourth embodiment of the present invention will be described with reference to the accompanying drawings. For simplification, the fourth embodiment will be described by a unit of four elements. FIG. 7 is a diagram showing the structure of an antenna device in accordance with the fourth embodiment of the present invention. FIG. 7 shows the structure of a receive system, and the D/A converter (digital/analog converter) of a transmit system and so on are omitted from the figure.

Referring to FIG. 7, reference symbol Ad denotes an A/D converter (analog/digital converter), and reference symbol S2 is a signal processing unit. In this example, the A/D converter is connected to each of the input terminals A1, A2, B1 and B2 of the 90-degree hybrids A and B, in which the receive signal (analog signal) of the beam is converted into a base band signal (digital signal).

Figure 8:
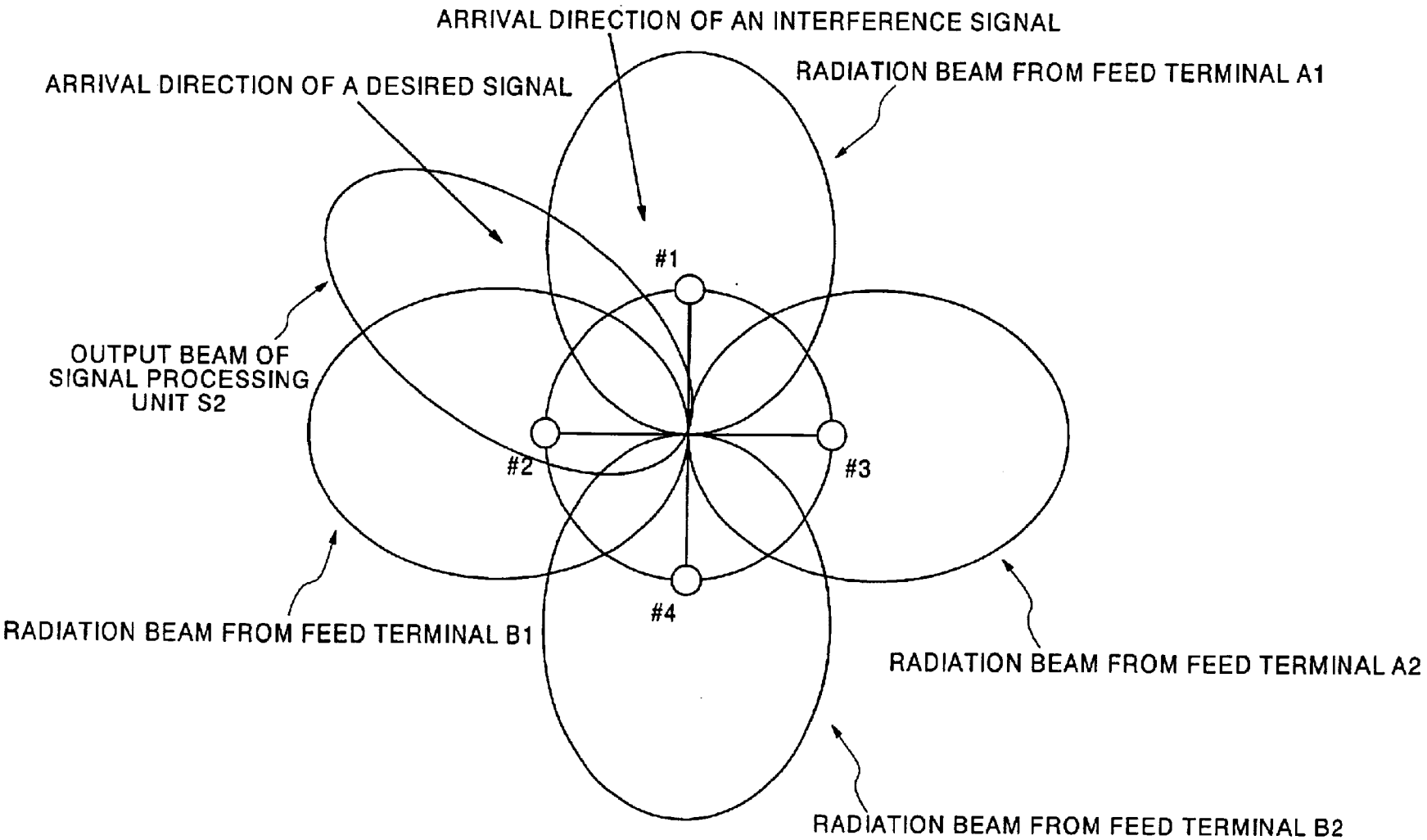
FIG. 8 is a diagram showing the radiation pattern of the antenna device in accordance with the fourth embodiment of the present invention.
Figure 9:
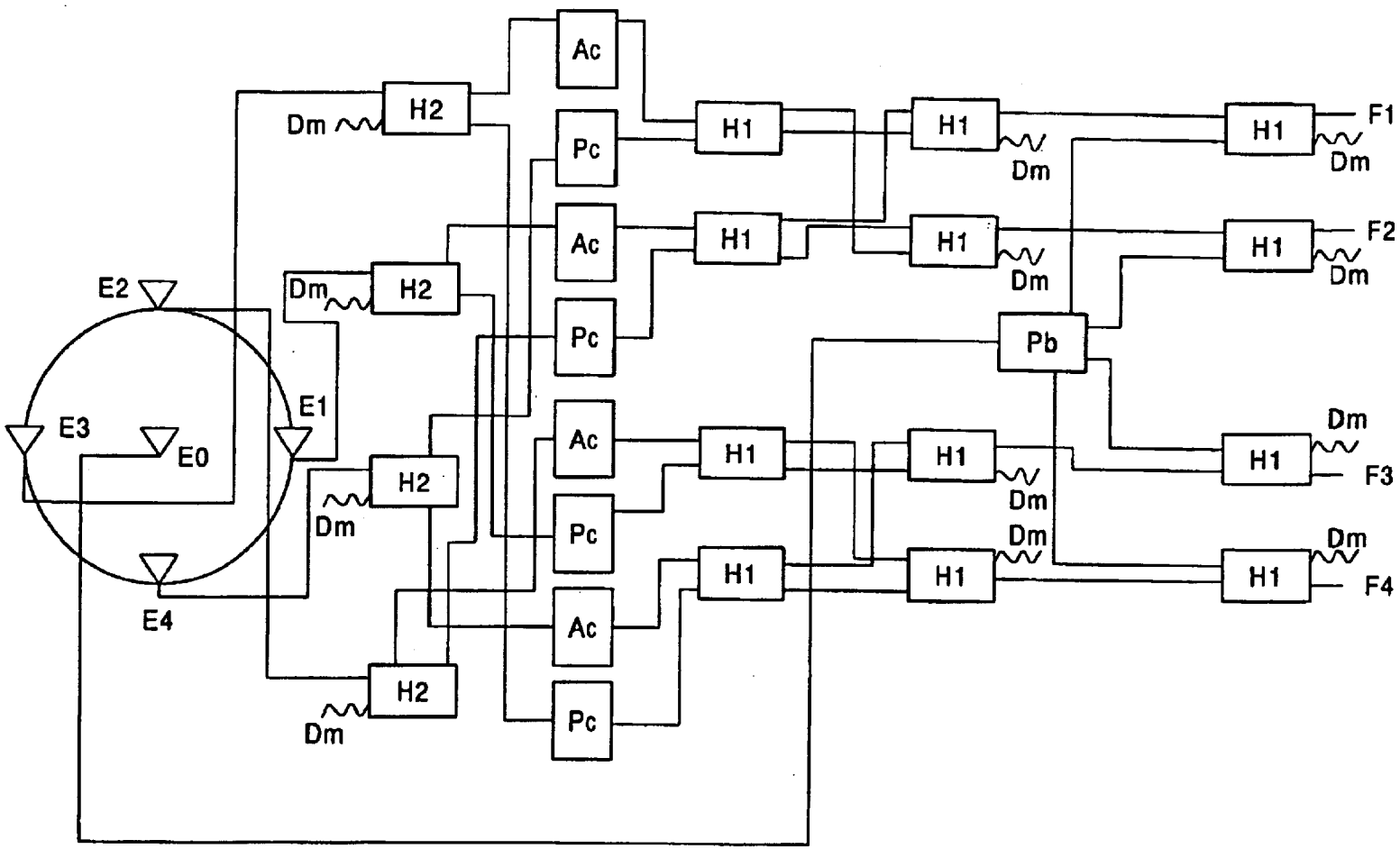
PRIOR ART FIG. 9
FIG. 9 is a diagram showing the structure of a conventional antenna device.

As the operation of the signal processing unit S2, a main beam is directed in an arrival direction of a desired signal, and a zero point of the directivity is formed in the arrival direction of an interference signal. Through this processing, as shown in FIG. 8, even under the electric wave environment where the interference signal arrives, it is possible to remove the influence thereof to conduct high-quality communication.

That is, the antenna device in accordance with the fourth embodiment is that in the antenna device in accordance with the first embodiment, an A/D converter is disposed at each of the input terminals A1, A2, B1 and B2 in the case of receiving, respectively, and a D/A converter is disposed at each of the input terminals A1, A2, B1 and B2 in the case of transmission, respectively; the beam is subjected to the base band signal processing by the signal processing unit S2 so that the main beam is directed in the arrival direction of the desired signal, and the zero point of the directivity is formed in the arrival direction of the interference signal.

Industrial Applicapability

The antenna device in accordance with claim 1 of the present invention, as described above, includes the first, second, third and fourth antenna elements which are arranged circumferentially at regular intervals, the first 90-degree hybrid having the first, second, third and fourth terminals, the second 90-degree hybrid having the fifth, sixth, seventh and eighth terminals, the third 90-degree hybrid having the ninth, tenth, eleventh and twelfth terminals, and the fourth 90-degree hybrid having the thirteenth, fourteenth, fifteenth and sixteenth terminals. In the antenna device, the third terminal of the first 90-degree hybrid and the ninth terminal of the third 90-degree hybrid are connected to each other, and the fourth terminal of the first 90-degree hybrid and the thirteenth terminal of the fourth 90-degree hybrid are connected to each other. Also, in the antenna device, the seventh terminal of the second 90-degree hybrid and the tenth terminal of the third 90-degree hybrid are connected to each other, and the eighth terminal of the second 90-degree hybrid and the fourteenth terminal of the fourth 90-degree hybrid are connected to each other. Further, the eleventh terminal of the third 90-degree hybrid and the first antenna element are connected to each other, and the twelfth terminal of the third 90-degree hybrid and the second antenna element are connected to each other. The fifteenth terminal of the fourth 90-degree hybrid and the third antenna element are connected to each other, and the sixteenth terminal of the fourth 90-degree hybrid and the fourth antenna element are connected to each other. Also, the passing phases of from the first terminal of the first 90-degree hybrid to the fourth terminal, from the second terminal to the third terminal, from the fifth terminal of the second 90-degree hybrid to the eighth terminal, from the sixth terminal to the seventh terminal, from the ninth terminal of the third 90-degree hybrid to the twelfth terminal, from the tenth terminal to the eleventh terminal, from the thirteenth terminal of the fourth 90-degree hybrid to the sixteenth terminal, and from the fourteen terminal to the fifteenth terminal are set to 0 degree. Similarly, the passing phases of from the first terminal of the first 90-degree hybrid to the third terminal, from the second terminal to the fourth terminal, from the fifth terminal of the second 90-degree hybrid to the seventh terminal, from the sixth terminal to the eighth terminal, from the ninth terminal of the third 90-degree hybrid to the eleventh terminal, from the tenth terminal to the twelfth terminal, from the thirteenth terminal of the fourth 90-degree hybrid to the fifteenth terminal, and from the fourteen terminal to the sixteenth terminal are set to 90 degrees. With the above-mentioned structure, there are obtained such advantages that the structure of the feed circuit can be simplified, and plural kinds of beams can be formed.

As described above, according to claim 2 of the present invention, there is provided an antenna device including: first, second, third and fourth antenna elements which are arranged circumferentially at regular intervals; a first 180-degree hybrid having the first, second, third and fourth terminals; a second 180-degree hybrid having the fifth, sixth, seventh and eighth terminals; and a third 180-degree hybrid having the ninth, tenth, eleventh and twelfth terminals, in which the third terminal of the first 180-degree hybrid and the fifth terminal of the second 180-degree hybrid are connected to each other, the fourth terminal of the first 180-degree hybrid and the ninth terminal of the third 180-degree hybrid are connected to each other, the seventh terminal of the second 180-degree hybrid and the first antenna element are connected to each other, the eighth terminal of the second 180-degree hybrid and the second antenna element are connected to each other, the eleventh terminal of the third 180-degree hybrid and the third antenna element are connected to each other, and the twelfth terminal of the third 180-degree hybrid and the fourth antenna element are connected to each other, in which the passing phases of from the first terminal of the first 180-degree hybrid to the fourth terminal, from the second terminal to the third terminal, from the fifth terminal of the second 180-degree hybrid to the eighth terminal, from the sixth terminal to the seventh terminal, from the ninth terminal of the third 180-degree hybrid to the twelfth terminal, and from the tenth terminal to the eleventh terminal are set to 0 degree, and in which the passing phases of from the first terminal of the first 180-degree hybrid to the third terminal, from the second terminal to the fourth terminal, from the fifth terminal of the second 180-degree hybrid to the seventh terminal, from the sixth terminal to the eighth terminal, from the ninth terminal of the third 180-degree hybrid to the eleventh terminal, and from the tenth terminal to the twelfth terminal are set to 180 degrees. With the above-mentioned structure, there are obtained such advantages that the structure of the feed circuit can be simplified, and plural kinds of beams can be formed.

As described above, according to claim 3 of the present invention, there is provided an antenna device further including in the antenna device as claimed in claim 1, a signal processing unit that composes the beams by multiplying a complex excitation amplitude whose amplitude is in proportion to the amplitudes of the signals which are received at the first and second terminals of the first 90-degree hybrid and the fifth and sixth terminals of the second 90-degree hybrid, and whose phase is the inversion of the signs of the phases of the signals of the fifth and sixth terminals of the second 90-degree hybrid. With this structure, there can be obtained such advantages that even in the case where a signal arrives between the respective beams, the directivity therebetween is enhanced, and the maximum ratio gain composition can be realized.

As described above, according to claim 4 of the present invention, there is provided an antenna device further including in the antenna device as claimed in claim 1, a signal processing unit that directs a main beam in an arrival direction of a desired signal and forms a zero point of the directivity of the beam in an arrival direction of an interference signal on the basis of the signals which are inputted from the first and second terminals of the first 90-degree hybrid and the fifth and sixth terminals of the second 90-degree hybrid. With this structure, there can be obtained such advantages that even under the electric wave environment where the interference signal arrives, it is possible to remove the influence thereof and the high-quality communication can be conducted.

What is claimed is:

1. An antenna device comprising:

first, second, third and fourth antenna elements which are arranged circumferentially at regular intervals;

a first 180-degree hybrid having first, second, third and fourth terminals;

a second 180-degree hybrid having fifth, sixth, seventh and eighth terminals;

a third 180-degree hybrid having ninth, tenth, eleventh and twelfth terminals;

wherein the third terminal of the first 180-degree hybrid and the fifth terminal of the second 180-degree hybrid are connected to each other, wherein the fourth terminal of the first 180-degree hybrid and the ninth terminal of the third 180-hybrid are connected to each other, wherein the seventh terminal of the second 180-degree hybrid and the first antenna element are connected to each other, wherein the eighth terminal of the second 180-degree hybrid and the second antenna element are connected to each other, wherein the eleventh terminal of the third 180-degree hybrid and the third antenna element are connected to each other, wherein the twelfth terminal of the third 180-degree hybrid and the fourth antenna element are connected to each other, wherein the passing phases of from the first terminal of the first 180-degree hybrid to the fourth terminal, from the second terminal to the third terminal, from the fifth terminal of the second 180-degree hybrid to the eighth terminal, from the sixth terminal to the seventh terminal, from the ninth terminal of the third 180-degree hybrid to the twelfth terminal, and from the tenth terminal to the eleventh terminal are set to 0 degree, and wherein the passing phases of from the first terminal of the first 180-degree hybrid to the third terminal, from the second terminal to the fourth terminal, from the fifth terminal of the second 180-degree hybrid to the seventh terminal, from the sixth terminal to the eighth terminal, from the ninth terminal of the third 180-degree hybrid to the eleventh terminal, and from the tenth terminal to the twelfth terminal are set to 180 degrees.

2. An antenna device, comprising:

first, second, third and fourth antenna elements which are arranged circumferentially at regular intervals;

a first 90-degree hybrid having first, second, third and fourth terminals;

a second 90-degree hybrid having fifth, sixth, seventh and eighth terminals;

a third 90-degree hybrid having ninth, tenth, eleventh and twelfth terminals, and a fourth 90-degree hybrid having thirteenth, fourteenth, fifteenth, and sixteenth terminals, a signal processing unit that composes beams by multiplying a complex excitation amplitude whose amplitude is in proportion to the amplitudes of the signals which are received at the first and second terminals of the first 90-degree hybrid and the fifth and sixth terminals of the second 90-degree hybrid, and whose phase is the inversion of the signs of the phases of the signals of the first and second terminals of the first 90-degree hybrid and the fifth and sixth terminals of the second 90-degree hybrid, wherein the third terminal of the first 90-degree hybrid and the ninth terminal of the third 90-degree hybrid are connected to each other, wherein the fourth terminal of the first 90-degree hybrid and the thirteenth terminal of the fourth 90-degree hybrid are connected to each other, wherein the seventh terminal of the second 90-degree hybrid and the tenth terminal of the third 90-degree hybrid are connected to each other, wherein the eighth terminal of the second 90-degree hybrid and the fourteenth terminal of the fourth 90-degree hybrid are connected to each other, wherein the eleventh terminal of the third 90-degree hybrid and the first antenna element are connected to each other, wherein the twelfth terminal of the third 90-degree hybrid and the second antenna element are connected to each other, wherein the fifteenth terminal of the fourth 90-degree hybrid and the third antenna element are connected to each other, wherein the sixteenth terminal of the fourth 90-degree hybrid and the fourth antenna element are connected to each other, wherein the passing phases from the first terminal of the first 90-degree hybrid to the fourth terminal, from the second terminal to the third terminal, from the fifth terminal of the sixth 90-degree hybrid to the eighth terminal, from the sixth terminal to the seventh terminal, from the ninth terminal of the third 90-degree hybrid to the twelfth terminal, from the tenth terminal to the eleventh terminal, from the thirteenth terminal of the fourth 90-degree hybrid to the sixteenth terminal, and from the fourteenth terminal to the fifteenth terminal are set to 0 degree, and wherein the passing phases of from the first terminal of the first 90-degree hybrid to the third terminal, from the second terminal to the fourth terminal, from the fifth terminal of the second 90-degree hybrid to the seventh terminal, from the sixth terminal to the eighth terminal, from the ninth terminal of the third 90-degree hybrid to the eleventh terminal, from the tenth terminal to the twelfth terminal, from the thirteenth terminal of the fourth 90-degree hybrid to the fifteenth terminal, and from the fourteenth terminal to the sixteenth terminal are set to 180 degrees.

3. An antenna device, comprising:

first, second, third and fourth antenna elements which are arranged circumferentially at regular intervals;

a first 90-degree hybrid having first, second, third and fourth terminals;

a second 90-degree hybrid having fifth, sixth, seventh and eighth terminals;

a third 90-degree hybrid having ninth, tenth, eleventh and twelfth terminals, and a fourth 90-degree hybrid having thirteenth, fourteenth, fifteenth, and sixteenth terminals, a signal processing unit that directs a main beam in an arrival direction of a desired signal and forms a zero point of the directivity of the beam in an arrival direction of an interference signal on the basis of the signals which are inputted from the first and second terminals of the first 90-degree hybrid and the fifth and sixth terminals of the second 90-degree hybrid, wherein the third terminal of the first 90-degree hybrid and the ninth terminal of the third 90-degree hybrid are connected to each other, wherein the fourth terminal of the first 90-degree hybrid and the thirteenth terminal of the fourth 90-deiree hybrid are connected to each other, wherein the seventh terminal of the second 90-degree hybrid and the tenth terminal of the third 90-degree hybrid are connected to each other, wherein the eighth terminal of the second 90-degree hybrid and the fourteenth terminal of the fourth 90-degree hybrid are connected to each other, wherein the eleventh terminal of the third 90-degree hybrid and the first antenna element are connected to each other, wherein the twelfth terminal of the third 90-degree hybrid and the second antenna element are connected to each other, wherein the fifteenth terminal of the fourth 90-degree hybrid and the third antenna element are connected to each other, wherein the sixteenth terminal of the fourth 90-degree hybrid and the fourth antenna element are connected to each other, wherein the passing phases from the first terminal of the first 90-degree hybrid to the fourth terminal, from the second terminal to the third terminal, from the fifth terminal of the sixth 90-degree hybrid to the eighth terminal, from the sixth terminal to the seventh terminal, from the ninth terminal of the third 90-degree hybrid to the twelfth terminal, from the tenth terminal to the eleventh terminal, from the thirteenth terminal of the fourth 90-degree hybrid to the sixteenth terminal, and from the fourteenth terminal to the fifteenth terminal are set to 0 degree, and wherein the passing phases of from the first terminal of the first 90-degree hybrid to the third terminal, from the second terminal to the fourth terminal, from the fifth terminal of the second 90-degree hybrid to the seventh terminal, from the sixth terminal to the eighth terminal, from the ninth terminal of the third 90-degree hybrid to the eleventh terminal, from the tenth terminal to the twelfth terminal, from the thirteenth terminal of the fourth 90-degree hybrid to the fifteenth terminal, and from the fourteenth terminal to the sixteenth terminal are set to 180 degrees.

* * * * *